United States Patent [19]

Secon

[11] 4,347,862

[45] Sep. 7, 1982

[54] LAWN UMBRELLA

[75] Inventor: Edward Secon, Trumbull, Conn.

[73] Assignee: The Sherwood Corporation, Spring City, Tenn.

[21] Appl. No.: 266,459

[22] Filed: May 22, 1981

[51] Int. Cl.[3] ..... A45B 11/00; A45B 17/00

[52] U.S. Cl. ..... 135/20 R

[58] Field of Search ..... 135/20 R, 21, 25 R, 135/25 A, 26, 29, 31; 244/153 R; D3/5

[56] References Cited

U.S. PATENT DOCUMENTS

| | | | |
|---|---|---|---|
| 2,871,868 | 2/1959 | Faasse | 135/20 R |
| 3,252,469 | 5/1966 | Peake | 135/20 R |
| 3,314,630 | 4/1967 | Lewis | 244/153 R |
| 3,709,238 | 1/1973 | Leopoldi | 135/20 R |
| 4,015,802 | 4/1977 | Heredia | 244/153 R |
| 4,312,371 | 1/1982 | Koon | 135/20 R X |

*Primary Examiner*—Harland S. Skogquist

*Attorney, Agent, or Firm*—Alan Ruderman

[57] ABSTRACT

A lawn umbrella having a substantially square shaped shade, the opposed corners of which are secured to respective first and second struts. A first of the struts has an outwardly bowed configuration to tense the shade and is positioned within a sleeve at the top of a rotatable mast. The second strut has an inwardly bowed configuration and is positioned within a slideway on the mast below the top. The inclination of the shade may be varied merely by moving the second strut within the slideway.

7 Claims, 4 Drawing Figures

LAWN UMBRELLA

BACKGROUND OF THE INVENTION

This invention relates to umbrellas or sunshades and more particularly to an outdoor umbrella of the stationary type generally known as a lawn umbrella, the shade having a noncircular periphery.

With the exception of the hyperbolic paraboloid umbrella illustrated in U.S. Pat. No. 3,252,469, the known prior art umbrellas generally include a shade having an inverted bowl configuration including a circular periphery supported by a multiplicity of struts or ribs emanating from the center. Although such constructions may be desirable for mobile hand held umbrellas which require rapid collapsibility, this requirement is not necessary for stationary lawn type umbrellas which are used generally as a sunshade. These umbrellas should have the capability of a readily adjustable shade to compensate for the relative movement of the sun during the day. Present umbrellas of this type, since they have a multiplicity of struts, require complicated articulating mechanisms and tiltable support poles to adjust the inclination of the shade. Such mechanisms not only add to the cost of the umbrellas, but they limit the aesthetic design available, the latter being an important element toward marketing a lawn type umbrella.

SUMMARY OF THE INVENTION

The present invention provides a lawn umbrella having a unique shade configuration supported by a minimum number of support struts, the shade being tiltable with a strut slidable relative to the mast so as to change elevational inclination toward the sun.

To this end the present invention provides a lawn umbrella having a substantially quadrilateral shade configuration, and a strut fastened to and between opposite corners of the shade, a first of the struts carried by the mast having an outwardly bowed configuration and engaging the inner surface of the shade, the second strut having an inwardly bowed configuration disposed below the surface of the shade except at the corners and slidable relatively to the support mast. Preferably the upper end of the upstanding support mast and the surface of the shade have guides through which the first strut is received, the first strut rotating in the mast guide when the second strut is slidably moved to change the inclination of the umbrella relatively to the sun. The mounting of the second strut on the support mast is preferably a narrow guide so that the strut can tilt within and relatively to the guide as a fulcrum, thereby allowing the corner of the shade fastened to the shorter end of the second strut to be disposed at a higher elevation than the opposed corner of the shade. The umbrella supporting mast may be carried within and rotatable relatively to an upstanding guide so the umbrella structure can be rotated.

BRIEF DESCRIPTION OF THE DRAWINGS

The particular features and advantages of the invention as well as other objects will become apparent from the following description taken in connection with the accompanying drawings, in which.

DESCRIPTION OF THE PREFERRED EMBODIMENT

Figure 1:
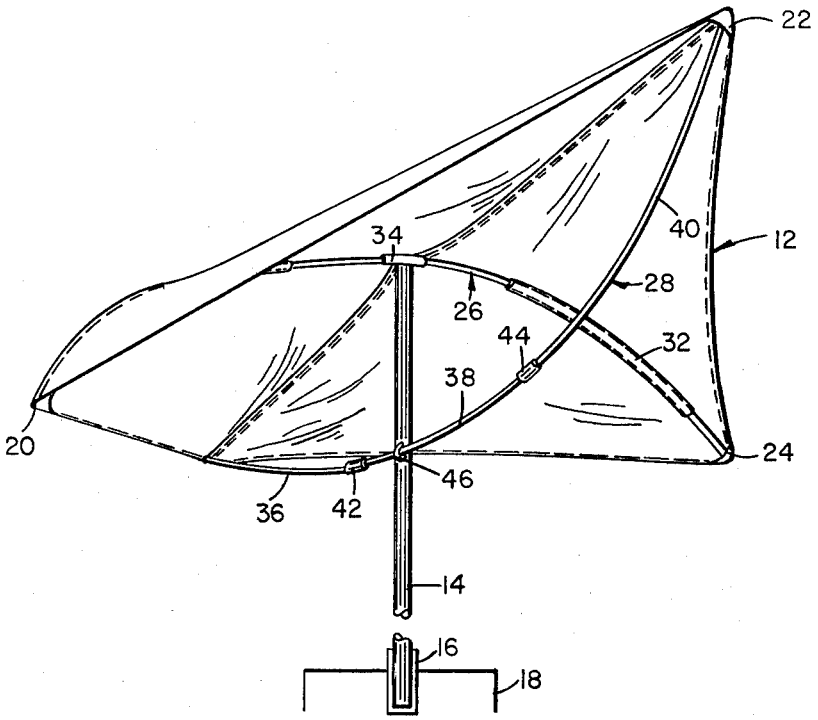
FIG. 1 is a perspective view of a lawn umbrella constructed in accordance with the principles of the present invention and with the shade in an inclined disposition.
Figure 2:
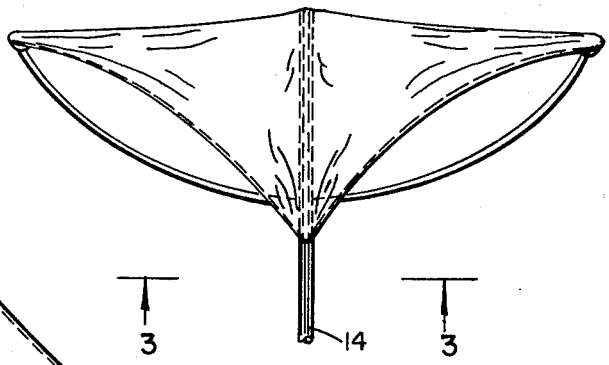
FIG. 2 is an elevational view of the umbrella illustrated in FIG. 1 viewed along a first diagonal of the shade.
Figure 3:
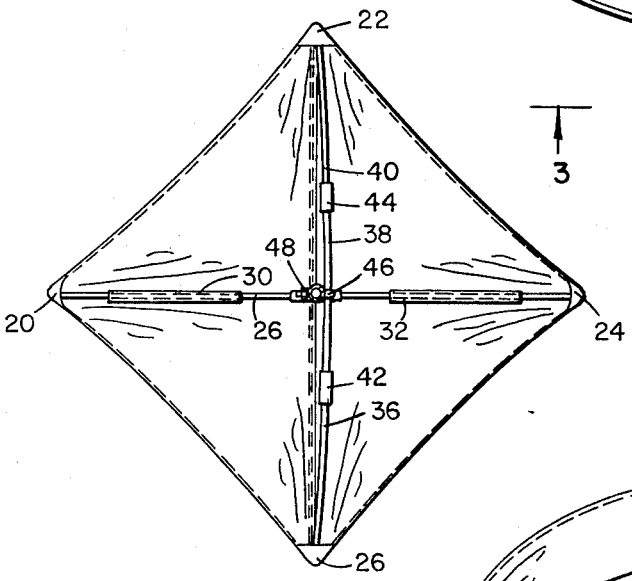
FIG. 3 is a cross sectional view taken substantially along line 3—3 of FIG. 2.
Figure 4:
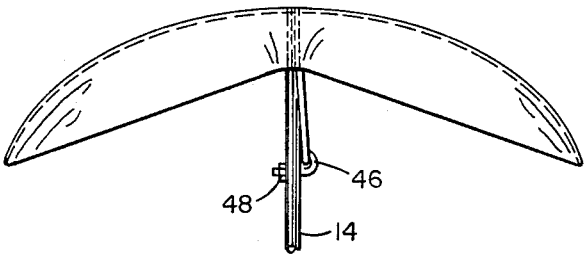
FIG. 4 is an elevational view similar to FIG. 2 with the mast rotated substantially 90 degrees from the position illustrated in FIG. 2.

Referring now to the drawings, a lawn umbrella constructed in accordance with the present invention is illustrated at 10 and generally comprises a shade 12 mounted on the end of a mast 14 as hereinafter described, the mast being rotatably receivable within a sleeve type receptacle 16 secured to a stable support structure such as a table 18. The shade 12 of the present invention is a relatively thin fabric or similar covering such as nylon or other suitable material. Preferably the peripheral edge configuration of the shade is square, but most if not any quadrilateral shape would function suitably, as will hereinafter be understood from this description. The shade may be constructed from a single piece of material or may be assembled by seaming a number of sectors together, and the edges of each side may be strengthened by seams or welts.

At each corner of the shade is a small respective pouch or pocket 20, 22, 24, 26 secured to the shade at the periphery of the corner and having an open edge facing toward the central portion of the cover. The pouches may be triangular pieces of fabric seamed to the corners of the shade, one apex of the pouch and the adjacent edges being attached to the corner of the shade. A first pair of opposed pouches 20 and 24 are adapted to receive a first strut member 26 while the second opposed pouches receive a second strut member 28. Intermediate the central section of the shade and each of the pouches 20 and 24 is a respective sleeve 30 and 32 formed by sewing or otherwise attaching a piece of fabric to the cover material, each sleeve 30, 32 being adapted for slidably receiving the strut 26.

At its uppermost end the mast 14 carries a hollow cylindrical sleeve 34 which is secured thereto. In the preferred form the mast and the sleeve 34 are metallic and are secured together as by brazing or welding. To assemble the strut 26 to the shade cover the strut 26 is threaded through a first of the fabric sleeves 30, 32, through the mast sleeve 34 and then through the other fabric sleeve 30, 32, the ends of the strut 26 thereafter being positioned within the pouches 20 and 24. The strut 26 has an arcuate configuration bowing outwardly from the interior of the umbrella, i.e. the center of curvature is beneath the shade. Thus, the strut actively engages and stretches the surface of the shade to tension it into an outwardly bowed or convex configuration relatively to the interior of the umbrella.

The second strut member 28 has an arcuate configuration bowing inwardly toward the interior of the umbrella, the center of curvature being external of the top surface of the shade. Each of the ends of the strut 28 is received within a respective pouch 22 and 26 to pull the corners of the shade at the pouches 22 and 26 away from each other and to stretch the cover over the strut 26 to provide the shade with a unique configuration. The second strut 28 may, for ease of assembly or disassembly, comprise a number of members such as 36, 38, and 40 connected together by a pair of spaced cylindrical sleeve connectors 42, 44 telescopically receiving adjacent ends of the members 36, 38 and 38, 40 respectively.

Secured on the mast 14 at the vertical disposition below the sleeve 34 where the strut 28 intersects the mast when the pouches 20 and 24 are at substantially the same elevation, is a guide member in the form of a U-shaped or J-shaped clamp 46. The leg or legs of the clamp are received within the mast, at least one leg extending through the mast has threads at the end to receive a nut 48 for securely holding the clamp 46 on the mast. The strut 28 is positioned through the opening between the clamp and the mast with the sleeve members 42, 44 on either side of the clamp. The construction is such that the strut 28 can slide within the clamp as a fulcrum between the limits provided by the sleeves 42, 44 relatively to the mast to change the inclination of the umbrella shade. Thus, the vertical elevation of the ends of the shade at the pouches 22 and 26 can be varied merely by manually moving the strut to slide within the clamp thereby varying the length of the strut 28 between the clamp and the ends of the strut. In so doing, varying amounts of the shade can be positioned to screen the sun from beneath the umbrella shade, and by rotating the mast 14 relatively to the sleeve 16 the shade 12 may act as a screen for any relative azimuth and elevational position of the sun.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus described the nature of the invention, what is claimed herein is:

1. A lawn umbrella comprising, a mast, means for journally mounting said mast for rotation about a vertical axis, a flexible shade having a generally quadrilateral configuration disposed above the mast, a first strut having a bowed configuration between its ends, means for fastening the ends of the first strut to a first pair of opposed corners of the shade with the strut bowed such that the center of curvature is beneath the shade, means for mounting said first strut on the top of the mast for pivotable movement relative to the mast about an axis substantially normal to the axis of the mast, a second strut having a bowed configuration between its end, means for fastening the ends of the second strut to a second pair of opposed corners of the shade with the strut bowed such that the center of curvature is above the second strut, and means for mounting the second strut on the mast for transverse movement relative to the mast.

2. A lawn umbrella as recited in claim 1, wherein said means for fastening the ends of said first and second struts to said shade comprise a pouch formed at each corner of the shade.

3. A lawn umbrella as recited in claim 1, wherein said means for mounting said first strut on the mast comprises a sleeve for receiving said first strut.

4. A lawn umbrella as recited in claim 3, including means for fastening said first strut to the shade intermediate said sleeve and the respective corner.

5. A lawn umbrella as recited in claim 1, wherein said means for mounting said second strut on the mast comprises a slideway.

6. A lawn umbrella as recited in claim 1, wherein said shade has a parallelogram configuration.

7. A lawn umbrella as recited in claim 2, wherein each of said pouches comprises a triangular pocket secured to said shade at an apex and adjacent edges to the respective corner and adjacent edges of the shade, said pocket being open along the edge opposite the apex.

* * * * *

UNITED STATES PATENT AND TRADEMARK OFFICE

CERTIFICATE OF CORRECTION

PATENT NO. 4,347,862

DATED : September 7, 1982

INVENTOR(S) : Edward Secon

It is certified that error appears in the above—identified patent and that said Letters Patent is hereby corrected as shown below:

Column 4, line 12, "end" should be -- ends--

Signed and Sealed this

*Twenty-sixth* Day of *October 1982*

[SEAL]

*Attest:*

GERALD J. MOSSINGHOFF

*Attesting Officer*

*Commissioner of Patents and Trademarks*